US007941922B2

(12) United States Patent
Stark et al.

(10) Patent No.: US 7,941,922 B2
(45) Date of Patent: May 17, 2011

(54) METHOD OF MANUFACTURING A LIGHTWEIGHT VALVE

(75) Inventors: Holger Stark, Allmersbach (DE); Martin Schlegl, Rudersberg (DE)

(73) Assignee: Daimler AG, Stuttgart (DE)

( * ) Notice: Subject to any disclaimer, the term of this patent is extended or adjusted under 35 U.S.C. 154(b) by 1246 days.

(21) Appl. No.: 10/579,887

(22) PCT Filed: Nov. 6, 2004

(86) PCT No.: PCT/EP2004/012581

§ 371 (c)(1),
(2), (4) Date: May 18, 2006

(87) PCT Pub. No.: WO2005/049980

PCT Pub. Date: Jun. 2, 2005

(65) Prior Publication Data

US 2007/0125976 A1 Jun. 7, 2007

(30) Foreign Application Priority Data

Nov. 19, 2003 (DE) ..... 103 54 085

(51) Int. Cl.
*B21K 1/20* (2006.01)

(52) U.S. Cl. ..... 29/890.124; 29/888.45; 29/888.46; 251/356; 123/188.2; 123/188.3

(58) Field of Classification Search ..... 29/890.124, 29/888.45, 890.12, 890.122, 890.123, 888.4, 29/888.46; 251/356, 366; 123/41.34, 41.41, 123/188.2, 188.3
See application file for complete search history.

(56) References Cited

U.S. PATENT DOCUMENTS

| | | | | |
|---|---|---|---|---|
| 1,506,900 | A | 9/1924 | Greiner et al. | |
| 1,727,621 | A | 9/1929 | Taub | |
| 2,371,548 | A | 3/1945 | Saffady | 123/177 |
| 2,407,561 | A | 9/1946 | Lincoln | 123/188.3 |
| 2,439,240 | A | 4/1948 | Cummings | |
| 3,156,259 | A | 11/1964 | Havelka et al. | 137/516.23 |
| 3,395,747 | A * | 8/1968 | Thompson | 164/95 |

(Continued)

FOREIGN PATENT DOCUMENTS

AT 005 131 U1 3/2002

(Continued)

OTHER PUBLICATIONS

Machine Translation of DE3625590A1, Feb. 1988.*

(Continued)

*Primary Examiner* — David P Bryant
*Assistant Examiner* — Ryan J Walters
(74) *Attorney, Agent, or Firm* — Davidson, Davidson & Kappel, LLC

(57) ABSTRACT

A method for manufacturing a lightweight valve is provided. The lightweight valve includes a valve stem, a hollow valve cone and a valve disk closing the valve cone, the valve stem being provided with a hollow space at an end facing the valve disk, the valve disk also having a force transmission element extending through the hollow valve cone into the stem hollow space. The method includes producing a first one-piece component forming the valve disk with the force transmission element by casting, forming and/or a powder metallurgy method, producing a second component forming the valve stem and the valve cone and joining the first and second components together and connecting them by a material, non-positive and/or positive connection.

18 Claims, 2 Drawing Sheets

U.S. PATENT DOCUMENTS

| | | | | |
|---|---|---|---|---|
| 3,503,375 | A * | 3/1970 | Thompson | 123/188.3 |
| 3,911,875 | A | 10/1975 | Ysberg | 123/41.34 |
| 4,513,701 | A * | 4/1985 | Sternberg et al. | 123/188.3 |
| 5,044,604 | A * | 9/1991 | Topham et al. | 251/120 |
| 5,054,195 | A | 10/1991 | Keck et al. | 29/888.453 |
| 5,345,965 | A | 9/1994 | Blume | |
| 5,458,314 | A | 10/1995 | Bonesteel | 251/337 |
| 5,823,158 | A | 10/1998 | Heimann et al. | 123/188.3 |
| 6,009,843 | A * | 1/2000 | Griffin et al. | 123/188.3 |
| 6,263,849 | B1 | 7/2001 | Bonesteel et al. | 123/90.51 |
| 6,354,258 | B1 | 3/2002 | Abele et al. | 123/188.3 |
| 6,935,296 | B2 | 8/2005 | Abele et al. | 123/188.3 |
| 6,938,602 | B2 | 9/2005 | Hora et al. | 123/188.3 |
| 2007/0145322 | A1 * | 6/2007 | Stark et al. | 251/356 |
| 2008/0272325 | A1 * | 11/2008 | Schlegl et al. | 251/318 |

FOREIGN PATENT DOCUMENTS

| | | | |
|---|---|---|---|
| DE | 32 33 392 | | 3/1984 |
| DE | 36 25 590 | | 2/1988 |
| DE | 197 31 382 | | 1/1999 |
| DE | 198 04 053 | | 8/1999 |
| DE | 100 29 299 | C | 3/2003 |
| DE | 102 04 122 | C | 5/2003 |
| DE | 101 60 942 | | 6/2003 |
| DE | 102 57 505 | | 7/2003 |
| EP | 0 296 619 | | 12/1988 |
| EP | 709 552 | | 5/1996 |
| EP | 1 359 292 | | 11/2003 |
| FR | 2 071 137 | | 9/1971 |
| FR | 2 540 176 | | 8/1984 |
| GB | 476089 | | 12/1937 |
| GB | 1 405 606 | | 9/1975 |
| GB | 2 137 279 | | 10/1984 |
| JP | 56-142204 | | 10/1981 |
| JP | 8-210112 | A | 9/1992 |
| JP | 4-269312 | A | 8/1996 |
| JP | 2000-045730 | | 2/2000 |
| WO | WO 98/36159 | | 8/1998 |
| WO | WO 99/05397 | | 2/1999 |

OTHER PUBLICATIONS

English translation of AT 005 131 U1, 7 pages.

* cited by examiner

METHOD OF MANUFACTURING A LIGHTWEIGHT VALVE

The invention relates to a lightweight valve, in particular for internal combustion engines, in particular for internal combustion engines, comprising a valve stem, a hollow valve cone and a valve disk closing the valve cone, the valve stem being provided with a hollow space at its end facing the valve disk, and to a method for manufacturing the lightweight valve.

BACKGROUND

Lightweight valves of the kind referred to here are known (DE 198 04 053 A1). They are used inter alia as inlet and outlet valves for internal combustion engines and comprise a valve stem which is adjoined by a funnel/trumpet-shaped valve cone. For the purpose of weight reduction, the valve cone is hollow and has only a small wall thickness. The valve cone is closed at its end of greater diameter by means of a valve disk. Furthermore, the valve stem has a hollow space at its end facing the valve disk, by virtue of which the weight of the lightweight valve is further reduced.

As the valve disk is not supported on a large area owing to the hollow space in the valve cone and the valve cone moreover has only a small wall thickness, the valve disk may be deformed during operation by the combustion pressure in the combustion chamber of the internal combustion engine, which contributes to premature wear of the lightweight valve. Furthermore, the thin-walled valve cone may also be deformed. In order to prevent this, DE 198 04 053 A1 proposes making the valve stem so long that it rests with its end face on that flat side of the valve disk facing away from the combustion chamber, by virtue of which the disk is supported. In this connection, the valve stem, which is hollow or made of solid material, and the valve disk can be welded together in their contact region. An alternative proposal is to manufacture the valve stem and the valve disk in one piece, that is as one part. In other alternatives, the valve disk is supported against the valve stem by means of an intermediate piece designed in one piece on the valve cone or a separate sleeve fixed between valve stem and valve disk. It is a disadvantage of the known lightweight valves that their individual parts can in some cases be produced only in a costly way owing to their geometry which is defined by the construction concerned and that accurate alignment of the individual parts in relation to one another before the joining process can be brought about only with high outlay.

SUMMARY OF THE INVENTION

It is an object of the invention to provide an alternative to the lightweight valve of the kind referred to in the introduction. A further object of the invention consists in indicating a method for manufacturing the lightweight valve.

A lightweight valve according to the present invention has at least one force transmission element which is provided on the valve disk and extends through the hollow valve cone into the stem hollow space. Owing to the force transmission element which is formed or designed on or fastened to the valve disk, optimum introduction of the gas forces acting on the valve disk during operation of the lightweight valve into the valve stem can be ensured without inadmissibly great deformations of the valve disk and of the valve cone arising in this connection. Owing to the design according to the invention of the lightweight valve, it can be ensured that the valve cone is virtually force-free during operation of the lightweight valve, that is that only very small forces, if any, are introduced into the valve cone via the valve disk. The valve cone can therefore be designed with very thin walls, which is advantageous in manufacture of the same and moreover contributes to reducing the weight of the lightweight valve.

In an advantageous illustrative embodiment, the valve disk with the force transmission element provided thereon is made from the intermetallic phase titanium aluminide (TiAl) or a TiAl alloy by casting. This valve disk is of only light weight and is moreover extremely wear-resistant. According to another variant embodiment, the valve disk and the force transmission element are made of steel, in particular tool steel, and are produced by forging. According to a third variant embodiment, the valve disk and the at least one force transmission element designed in one piece with the valve disk are manufactured by means of a powder metallurgy production process, in particular from a tool steel which is extremely wear-resistant. It is common to all the variant embodiments mentioned above that the force transmission element is designed in one piece with the valve disk and can therefore be manufactured cost-effectively.

As far as the materials which can be used for the valve stem and the valve disk with the force transmission element provided thereon are concerned, reference is also made to DE 100 29 299 C2, the content of which with regard to the materials used is a subject of this description.

An illustrative embodiment of the lightweight valve in which the force transmission element projects in a dome-like manner above that flat side of the valve disk facing the valve cone is also preferred. In this connection, the force transmission element is in its simplest embodiment designed as a pin which can have a constant cross section over its length and is preferably arranged in the center of the valve disk. This variant embodiment of the force transmission element can be produced in a simple and cost-effective way both by casting and by forming or sintering.

The method according the present invention proposes that a first one-piece component forming the valve disk and the force transmission element is produced by primary forming and/or forming in a first step. A second one-piece component forming the valve stem and the valve cone is produced in a second step. According to a first variant embodiment, the valve cone is produced on the valve stem by flaring, that is by expanding the hollow stem end. According to a second variant embodiment, the valve cone and the valve stem are separate components which are interconnected to form the second component by material, non-positive and/or positive connection. Finally, in a third step, the first and second components are joined together by introducing the force transmission element into the valve stem and subsequently firmly interconnected by means of material, non-positive and/or positive connection.

In the variant embodiment of the lightweight valve in which the force transmission element is at the same time designed as means for aligning the valve disk relative to the valve cone, it is especially easy to join the individual components of the lightweight valve together.

BRIEF DESCRIPTION OF THE DRAWINGS

The invention is explained in greater detail below with reference to the drawing, in which.

DETAILED DESCRIPTION

Figure 1:
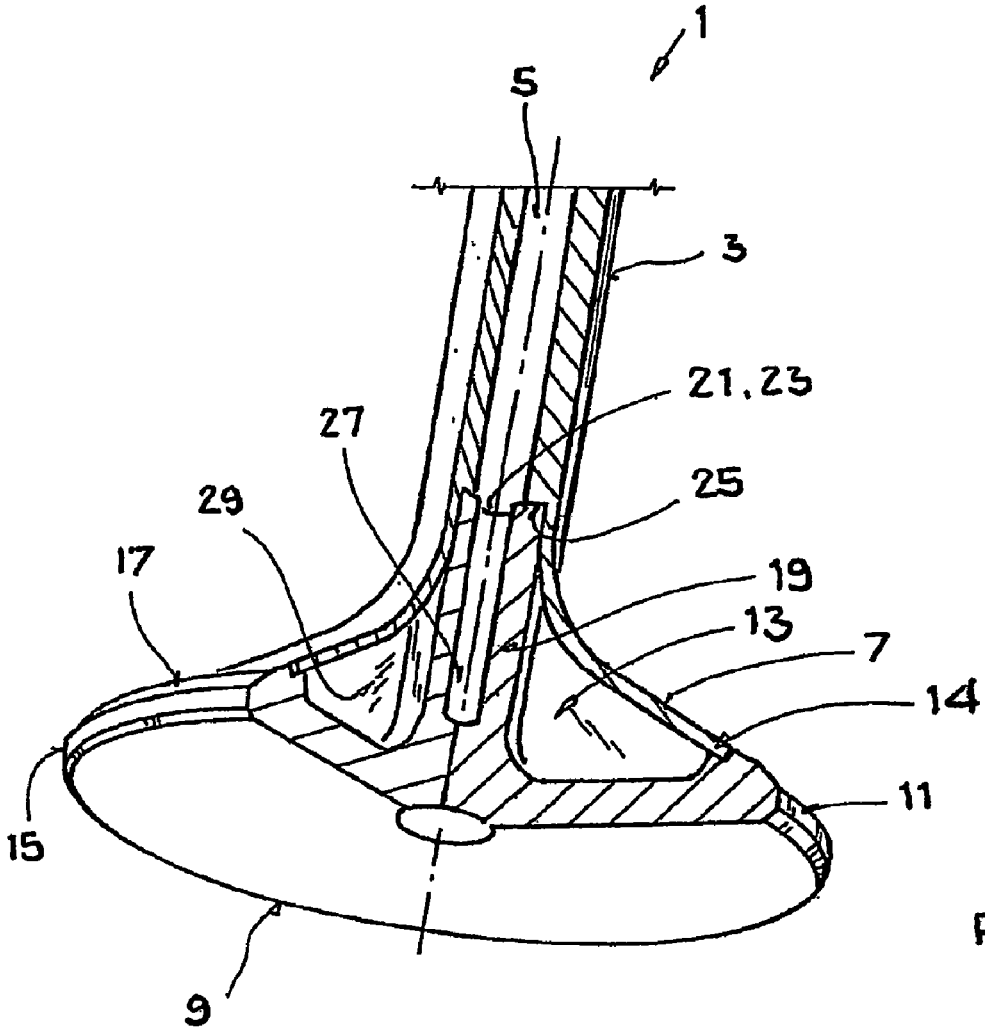
FIGS. 1 to 3 each shows a detail of an illustrative embodiment of a lightweight valve for internal combustion engines in a perspective, cutaway illustration.

FIG. 1 shows a first illustrative embodiment of a lightweight valve 1 of multi-part design for internal combustion engines. This can be used as a thermally less loaded inlet valve or as a thermally more highly loaded outlet valve, the material of the individual parts being selected accordingly depending on the use of the lightweight valve 1.

The lightweight valve 1 illustrated in FIG. 1 comprises a valve stem 3 which is provided with a stem hollow space 5. In this illustrative embodiment, the stem hollow space 5 is formed by a through-opening extending in alignment with the longitudinal central axis of the valve stem 3. The valve stem 3 can be formed by a precision-drawn tube made of steel, for example X45, and is closed at its end which is not illustrated by means of a valve stem endpiece/foot. The valve stem 3 has at its end which is illustrated in FIG. 1 a valve cone 7 which is formed by expanding the diameter of the valve stem end. The valve stem 3 and the valve cone 7 are therefore designed in one piece with one another. As can be seen from FIG. 1, the valve cone 7 is very thin-walled and has a smaller wall thickness than the valve stem 3. The expansion of the valve stem end and the special shape of the valve cone result in a conical transition from the stem hollow space 5 toward the valve cone 7.

The lightweight valve 1 also has a valve disk 9, by means of which the hollow valve cone 7 is closed. The valve disk 9 is provided on its flat side facing the valve cone 7 with a recess 13 of all-round design which is arranged at a radial distance from the valve disk peripheral surface 11 and into which the valve cone 7 projects with its end of greater diameter. In this connection, the recess 13 is designed in such a way that the transition between the valve disk 9 and the valve cone 7 in their connection region is continuous.

The recess 13 has in its edge region an all-round edge step 14 which serves for supporting or as a bearing shoulder for the valve cone 7. In the assembled state of the lightweight valve 1, the end face, located at the end of greater diameter, of the valve cone 7 engaging in the recess 13 is in bearing contact with the edge step 14. The recess 13, or the edge step 14, forms a centering and supporting seat for the valve cone 7.

The valve disk 9 is of disk-shaped design and has a first, cylindrical longitudinal portion 15 of constant cross section and, adjoining this, a conical, that is frustoconical, second longitudinal portion 17, the cone angle of the second longitudinal portion 17 being the same as the cone angle of the valve cone 9 at its end of greater diameter, by virtue of which the continuous transition is brought about in the connection region between these parts. The lateral surface of the longitudinal portion 17 usually forms the sealing surface of the lightweight valve 1.

The valve disk 9 has on its flat side facing the valve cone 7 or the valve stem 3 a force transmission element 19 which is located in the center of the valve disk 9 and in this illustrative embodiment is designed in one piece with the valve disk 9. The force transmission element 19 has a circular cross section which is constant essentially over the entire length. As can be seen from FIG. 1, the force transmission element 19 is designed with such a length that it extends through the hollow valve cone 7 and into the stem hollow space. The end face 21 of the force transmission element 19 extends in a direction at right angles to the longitudinal central axis of the valve stem 3 and here forms a stop surface 23 which interacts with an axial stop 25 provided in the stem hollow space 5. This stop is formed by an all-round annular shoulder against which the force transmission element 19 bears with its stop surface 23. The axial stop 25 is formed by a diameter jump in the stem hollow space 5, that is a longitudinal portion of smaller diameter of the stem hollow space 5 is adjoined by a longitudinal portion of greater diameter. The axial stop 25 can be formed by, for example, expanding the stem hollow space 5, by machining (drilling, milling, sinking) or by appropriate design of the original die in manufacture by means of a powder metallurgy method.

The arrangement of the axial stop 25 inside the stem hollow space 5 is selected in such a way that the end region of greater diameter of the valve cone 7 engages accurately in the recess 13 in the valve disk 9 when the force transmission element 19 comes up against the axial stop 25 with its end face 21.

In a preferred embodiment, the outside diameter of the force transmission element 19 is the same as or slightly larger than the diameter of the stem hollow space 5, so that, when the force transmission element 19 is inserted into the stem hollow space 5, a non-positive connection is formed between these parts which serves for prefixing the valve disk 9 to the valve stem 3. After the valve disk 9 and the valve stem 3 have been joined together in the way mentioned above, the valve stem 3 and the force transmission element 19 and also the valve disk 9 and the valve cone 7 are interconnected by material connection. The valve disk 9 and the valve cone 7 are welded to one another in their connection region located in the region of the recess 13, for example by means of laser beam. In the illustrative embodiment shown in FIG. 1, in particular soldering together is suitable as the joining method for connecting the force transmission element 19 and the valve stem 3. Other variants are of course also possible for firm, inseparable connection between force transmission element 19 and valve stem 3 and also valve disk 9 and valve cone 7.

The illustrative embodiment of the lightweight valve 1 shows in FIG. 1 is characterized by small wall thicknesses of the individual parts, in particular of the valve cone 9, and consequently by only a small weight. It is furthermore advantageous that the individual parts can be joined in a simple way by fitting together and in this connection relative alignment of valve disk and valve stem and also valve cone takes place at the same time by means of the force transmission element 19. The gas forces acting on the valve disk 9 during operation of the lightweight valve 1 are advantageously introduced into the valve stem 3 via the centrally arranged force transmission element 19, which is supported by the axial stop 25 provided on the valve stem 3. Owing to the construction referred to above of the lightweight valve 1, the gas forces acting on the valve disk 9 are not, or are only to a harmless extent, introduced into the very thin-walled valve cone 7. Deformation of the valve cone 7 can therefore reliably be excluded.

The stem hollow space 5, which is closed sealingly at its one end by means of the valve endpiece and at its other end by means of the force transmission element 19, can be filled with a cooling medium, for example sodium. To improve heat dissipation from the valve disk 9, a blind hole 27 made in the end face 21 of the force transmission element 19 is provided in the illustrative embodiment shown in FIG. 1, the hole extending to close to the disk-shaped basic body of the valve disk 9. The blind hole 27 is arranged in alignment with the stem hollow space 5 and is therefore likewise filled with the cooling medium.

In an illustrative embodiment which is not shown, the hollow space 29 formed between the valve disk 9, the valve cone 7 and the force transmission element 19 is also at least partly filled with the cooling medium. The hollow space 29 forms a first chamber and the stem hollow space 5 together with the blind hole 27 a second chamber, which chambers are interconnected via at least one bypass opening in the force transmission element 19 connecting the hollow space 29 to the blind hole 27 for the purpose of pressure compensation when heating of the cooling medium takes place. An exchange of cooling medium can therefore take place between the stem hollow space 5 and the hollow space 29 of the valve cone 7.

Figure 2:
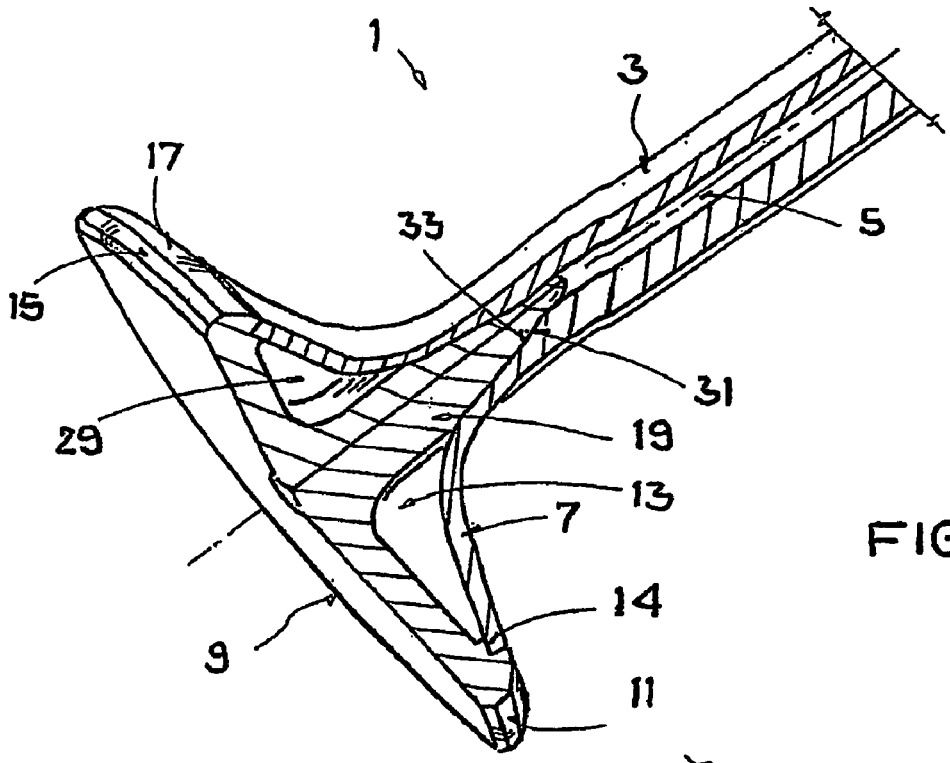

FIG. 2 shows a detail of a further illustrative embodiment of the lightweight valve 1. The same parts are provided with the same reference numbers, so that in this respect reference is made to the description for FIG. 1. The lightweight valve 1 differs from the illustrative embodiment shown in FIG. 1 in particular in that the force transmission element 19 designed on the valve disk 9 is designed to taper toward its free end. The free end of the force transmission element 19 has a conical shape, the outer side of the cone forming a bearing surface 31 of all-round design which, in the joined-together state of the valve disk 9 and the valve stem 3, bears flat against a correspondingly designed countersurface 33 provided in the stem hollow space 5. The countersurface 33 is formed by an appropriately conically designed widening of the stem hollow space 5 toward its end facing the valve cone 7. In the case of a valve stem 3 made of steel, the countersurface 33 can be formed by expanding the stem hollow space 5, for example.

Owing to the inclined, conically designed free end of the force transmission element 19, the illustrative embodiment of the lightweight valve 1 shown in FIG. 2 is suitable in particular for interconnecting the valve disk 9 and the valve stem 3 with a material connection by means of friction welding. In this illustrative embodiment as well, the connection of the force transmission element 19 to the valve stem 3 is selected in such a way that, after joining together of the valve disk 9 and the valve stem 3, that is after the force transmission element 19 has been introduced into the position intended for it in the stem hollow space 5, the end of greater diameter of the valve cone 7 engages in or projects into the recess 13 provided on the upper side of the valve disk 9 in an at least approximately force-free manner. It is conceivable for the valve cone 7 and the valve disk 9 also to be interconnected by means of friction welding at the same time as the valve disk 9 is connected to the valve stem 3 by means of friction welding. Alternatively, it is possible for the valve cone 7 to be connected to the valve disk 9 in the region of the recess 13 in a separate welding operation.

Figure 3:
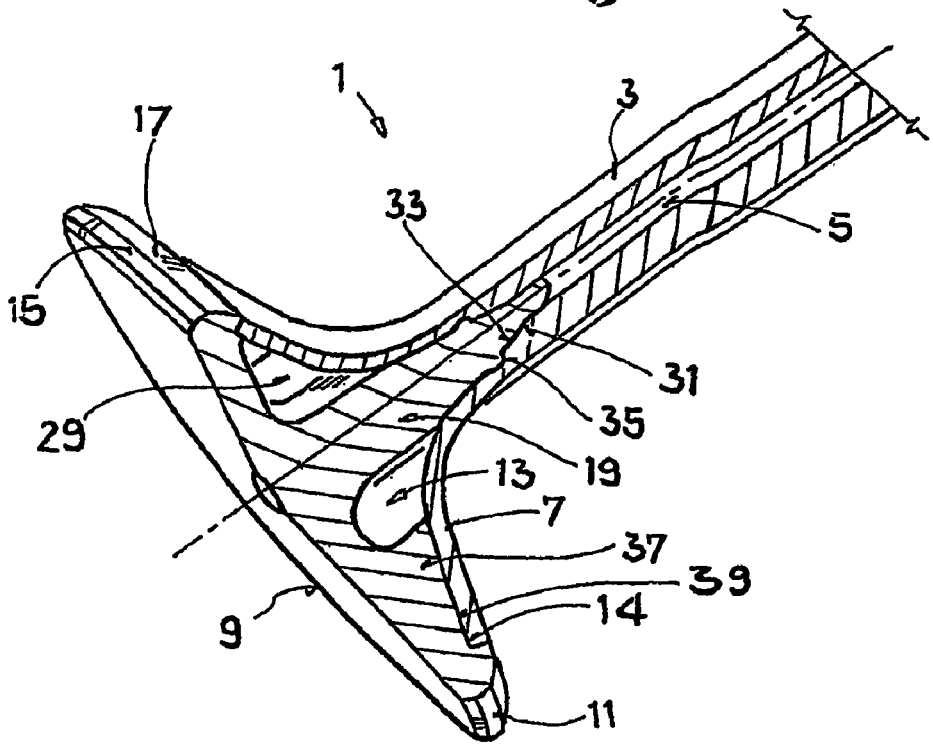

FIG. 3 shows a third illustrative embodiment of the lightweight valve 1, which differs from the lightweight valve 1 described with reference to FIG. 2 inter alia in that a recess 35 which serves to form a positive connection between force transmission element 19 and valve stem 5 is provided in the countersurface 33 which is provided on the inner wall of the stem hollow space 5 and widens conically toward the stem end. The recess 35 is formed by an all-round annular groove. By melting the force transmission element 19 on in the region of the recess 35, which can take place by means of capacitor discharge welding for example, the molten material of the force transmission element 19 flows into the recess 35. Additionally or alternatively, the force transmission element 19 can be soldered together with the valve stem 3.

In the illustrative embodiment according to FIG. 3, a number of reinforcing ribs 37, preferably three, molded into the valve disk 9 are provided in the recess 13, only one of the reinforcing ribs 37 being visible in the illustration according to FIG. 3. Seen in a top view of that flat side of the valve disk 9 facing the valve stem 3, the reinforcing ribs 37 extend radially in relation to the longitudinal central axis of the lightweight valve 1 and are arranged at a spacing of 120° from one another. The length of the reinforcing ribs 37 originating from the edge region of the recess 13 in the direction of the valve disk center corresponds approximately to half the radius of the valve disk 9. As can be seen from FIG. 3, the reinforcing ribs 37 are in this illustrative embodiment designed as rectilinear strips of which the height increases in the direction of the valve disk center.

The reinforcing ribs 37 are designed to complement the inner wall of the valve cone 7, so that the latter, in the joined-together state of the lightweight valve 1, rests flat with its inner wall on the upper narrow side 39 of the reinforcing ribs 37 and is consequently supported by these. The valve cone 7 and the reinforcing ribs 37 can be welded or soldered together on their bearing contact region.

The reinforcing ribs 37 therefore prevent deformation of the thin-walled valve cone 7 during operation of the lightweight valve 1 as a result of the gas forces acting on the outer side of the valve cone 7. A further function of the reinforcing ribs consists in aligning valve stem 3 and valve disk 9 accurately in relation to one another when they are being joined together if this is not already carried out precisely enough by means of the force transmission element 19 which engages in the stem hollow space 5.

Alternatively to the reinforcing ribs, a supporting portion of all-round design can also be provided, which can be designed identically in cross section to the reinforcing ribs described above.

It is common to the illustrative embodiments of the lightweight valve 1 described with reference to FIGS. 1 to 3 that the connection between the force transmission element 19 and the valve stem 3 is designed in such a way that the forces acting on the valve disk 9 during operation are introduced essentially completely via the force transmission element 19 into the valve stem 3 and the connection between valve disk 9 and valve cone 7 is designed in such a way that only very small forces, if any, are introduced into the valve cone 7 from the valve disk 9.

It remains to state that the valve stem 3 and the valve disk 9 can be made from the same material or from different materials. The connection between valve disk 9 and valve stem 3 can in particular be effected by means of friction welding, beam welding, fusion welding or capacitor discharge welding in all the illustrative embodiments of the lightweight valve described with reference to FIGS. 1 to 3 as well. Connecting the valve disk 9 and the extremely thin-walled valve cone 7 is preferably effected by means of beam, fusion or laser welding.

After valve stem 3 and valve cone 7 are joined with valve disk 9, valve stem 3 may be subsequently hardened, preferably inductively hardened, in the end region of valve stem 3 facing away from valve disk 9. Also, the outer surface of lightweight valve 1 may be provided with a protective layer by plating.

In summary, it remains to state that the lightweight valve 1 according to the invention is characterized in particular in that, in addition to its only small weight, it has only a few individual components, which can be interconnected with a few simple joining operations, so that it can be produced cost-effectively overall.

The advantages of the force transmission element have been described merely by way of example with reference to a lightweight valve in which the valve cone is designed in one piece with the valve stem. Such a force transmission element can of course also be used in a lightweight valve in which the valve cone is a separate component which at its end of greater diameter is fixed to the valve disk and at its end of smaller diameter is fixed to the valve stem and/or to the force transmission element engaging in the valve stem.

What is claimed is:

1. A method for manufacturing a lightweight valve with a valve stem, a hollow valve cone and a valve disk closing the valve cone, the method comprising:

producing a first one-piece component forming the valve disk with a force transmission element by casting, forming and/or a powder metallurgy method, the force transmission element including a first end integrally connected to a center of the valve disk and a second end defining a stop surface;

producing a second one-piece component forming the valve stem and the valve cone, the second one-piece component having an inner wall defining a hollow space within the valve stem and the valve cone, the valve stem including an annular shoulder formed by a width increase of the hollow space into the inner wall; and joining the first and second components together by placing the force transmission element into the hollow space, bringing the stop surface of the force transmission element to bear against the annular shoulder and connecting the first and second components by at least one of a material, non-positive and positive connection.

2. The method as claimed in claim 1 wherein the annular shoulder is fully circular.

3. The method as claimed in claim 1 wherein the annular shoulder has a surface extending in a plane that is perpendicular to a longitudinal central axis of the valve stem.

4. The method as claimed in claim 1 wherein the force transmission element has a constant cross section over an entire length thereof.

5. The method as claimed in claim 1 wherein the second end the force transmission element has an end face with a blind hole.

6. The method as claimed in claim 1 wherein the valve cone is formed by a tulip-shaped widening of the end of the valve stem.

7. The method as claimed in claim 1 wherein a connection between the force transmission element and valve stem is designed so that forces acting on the valve disk during operation are introduced via the force transmission element into the valve stem.

8. The method as claimed in claim 1 wherein the valve disk has a supporting portion against which the valve cone bears flat in sections in an end region of greater diameter.

9. The method as claimed in claim 1 wherein the valve stem is subsequently hardened in an end region facing away from the valve disk.

10. The method as claimed in claim 9 wherein the valve stem is inductively hardened.

11. The method as claimed in claim 1 wherein the valve cone and the valve disk are welded together.

12. The method as recited in claim 11 wherein the valve cone and the valve disk are welded together by beam welding or fusion welding.

13. The method as claimed in claim 1 wherein an outer surface of the lightweight valve is provided with a protective layer by plating.

14. The method as recited in claim 1 wherein the valve disk has a recess defined therein that has an edge region including an edge step and the joining step includes engaging an end of greater diameter of the hollow valve cone in the recess of the valve disk and welding the valve cone in the recess.

15. A method for manufacturing a lightweight valve with a valve stem, a hollow valve cone and a valve disk closing the valve cone, the valve stem being provided with a hollow space at an end facing the valve disk, the valve disk also having a force transmission element extending through the hollow valve cone into the stem hollow space, the method comprising:

producing a first one-piece component forming the valve disk with the force transmission element by casting, forming and/or a powder metallurgy method, the force transmission element including a first end integrally connected to a center of the valve disk and a second end including a bearing surface having a conical shape;

producing a second one-piece component forming the valve stem and the valve cone, the second one-piece component having an inner wall defining a hollow space within the valve stem and the valve cone, the inner wall increasing in width as the second one-piece component extends away from the valve cone to the valve stem such that a portion of the inner wall of the valve stem forms a countersurface having a conical shape; and joining the first and second components together by placing the force transmission element into the hollow space, bringing the bearing surface of the force transmission element to bear against the countersurface and connecting the first and second components by at least one of a material, non-positive and positive connection.

16. The method as recited in claim 15 wherein the bearing surface also bears against an inner wall of the hollow valve cone.

17. The method as claimed in claim 15 wherein the countersurface is provided with at least one recess for forming a positive connection between force transmission element and valve stem.

18. The method as claimed in claim 17 wherein the recess is formed as an annular groove.

* * * * *